United States Patent [19]

Franklin et al.

[11] 4,061,465

[45] Dec. 6, 1977

[54] CREASABLE DURABLE PRESS TEXTILES FROM METHYLOL REAGENTS AND HALF AMIDES OR HALF SALTS OF DICARBOXYLIC ACIDS

[75] Inventors: William E. Franklin; John P. Madacsi; Stanley P. Rowland, all of New Orleans, La.

[73] Assignee: The United States of America as represented by the Secretary of Agriculture, Washington, D.C.

[21] Appl. No.: 673,015

[22] Filed: Apr. 2, 1976

[51] Int. Cl.[2] ..... D06M 13/40

[52] U.S. Cl. ..... 8/185; 8/181; 8/194; 8/195; 8/196

[58] Field of Search ..... 8/181, 185, 194, 196, 8/195

[56] References Cited

U.S. PATENT DOCUMENTS

| | | | |
|---|---|---|---|
| 3,006,879 | 10/1961 | Ryan et al. | 428/528 |
| 3,565,824 | 2/1971 | Pierce et al. | 252/429 |
| 3,776,692 | 12/1973 | Franklin et al. | 8/181 |
| 3,796,540 | 3/1974 | Harper et al. | 8/18 |

*Primary Examiner*—John Kight, III

*Attorney, Agent, or Firm*—M. Howard Silverstein; David G. McConnell; Salvador J. Cangemi

[57] ABSTRACT

Cellulosic textiles are impregnated with an aqueous solution containing a methylol crosslinking reagent and either a half amide of a 1,2- or 1,3-dicarboxylic acid or a half ammonium, sodium, or potassium salt of a 1,2- or 1,3-dicarboxylic acid. After the impregnated textiles are cured, they have high levels of crosslinking as indicated by high resilience and high levels of acidic groups as indicated by basic dye adsorption and the ability to form new, permanent creases when pressed at high temperatures.

28 Claims, No Drawings

CREASABLE DURABLE PRESS TEXTILES FROM METHYLOL REAGENTS AND HALF AMIDES OR HALF SALTS OF DICARBOXYLIC ACIDS

FIELD OF THE INVENTION

This invention relates to the improvement of cellulosic textiles. Specifically, this invention relates to the modification of cellulosic textiles to give them improved properties of resilience, smooth drying, permanent creasability, and acidic character. More specifically, this invention relates to improved combination of catalysts crosslinking reagents, and processes which give cellulosic textiles improved durable press, creasability, and acidic properties. This invention constitutes an improved method of producing creasable durable-press fabrics and garments having improved easy care properties.

BACKGROUND AND PRIOR ART

It is well known to those skilled in the art of textile finishing that wrinkle-resistance and smooth drying properties are imparted to cellulosic or cellulsoic blend textiles by chemical treatment which form covalent crosslinks between cellulose molecules in the fibers of these textiles. The crosslinks hold the cellulose molecules in place and therefore impart resilience and a preferred configuration to the cellulosic fibers. As a result, the finished textile has resistance to wrinkling during use and laundering and also permanent creases or flat seams which cannot be removed without employing chemical reactions which removes the crosslinks between the cellulose molecules.

In the textile finishing industry, the conventional method of forming crosslinks in cellulosic textiles involves the use of a pad-dry-cure process in which a methylol crosslinking reagent, such as dimethyloldihydroxyethyleneurea, methylol melamines, or formaldehyde is reacted with the cellulose of the fibers in the presence of an acidic catalyst, usually a latent acid metal salt such as magnesium chloride or zinc nitrate. More recently, the state of the art has been improved by the discovery that polycarboxylic acids, when used as catalyst in methylol crosslinking reactions with cellulose, become attached to the cellulose fibers and are thus permanently available to catalyze recuring reactions. In such recuring processes, which may be performed at any time after the original cure, the methylol crosslinks are moved within the cellulose matrix and a new preferred configuration is imparted to the cellulosic fiber. As a result, such recurable fabrics may be heat formed into new, permanent configurations, such as new sharp creases, flat seams, or hems without adding chemical reagents and while still retaining desirable durable press properties. That invention has been disclosed as U.S. Pat. No. 3,776,692, issued on December 12. 1973. The polycarboxylic acids of the above invention are organic compounds containing three or more carboxyl groups per molecule. They are specialty organic compounds which are not produced in large amounts and therefore are very costly for use in large-scale textile finishing processes. In addition, those acids are used as the free carboxylic acids, not as partial salts of the acids.

It has also previously been disclosed that amic acids react with cellulosic fibers. This reaction results in the attachment of the amic acid molecules to the cellulose molecules by way of ester groups. Ammonia is lost during the reaction with the result that free carboxylic acid groups become attached to the cellulose fiber. The reactions of amic acids with cellulose are more fully disclosed in U.S. Pat. No. 3,555,585 and No. 3,671,184, to Cuculo. In these patents, large concentrations of amic acids or anhydride/ammonia solutions are applied to rayon textiles to produce modified textiles which are not crosslinked but have high water absorption. These patents do not disclose or speculate on the use of amic acid as catalysts for methylol crosslinking reactions, either simultaneously with or subsequent to their application to the cellulosic textile, and much less as catalysts for subsequent recuring reactions of methylol crosslinks.

The reaction of polycarboxylic acids with fibrous cellulose has been disclosed by Rowland, et al. in U.S. Pat. No. 3,526,048. This patent also discloses the use of carboxylic acids which are partially neutralized by alkali metal bases, ammonia, or organic amines. The polycarboxylic acids are used as the only crosslinking reagents in this process, and the creasability which is claimed in this patent is a result of transesterification reactions of the polycarboxylic acids. This patent does not disclose or even speculate on any use or catalysis of methylol crosslinking reagents in conjunction with the polycarboxylic acids.

OBJECT OF THE INVENTION

A primary object of this invention is to provide treated textiles or textile products which have smooth-drying and wrinkle-resistant properties, but which can be heat-set at any time after the cure in order to impart new permanent creases, pleats, or flat seams to the treated textiles.

Another object of this invention is to provide textile treating compositions, formulations, and methods for making creasable fabrics which can be used in the construction of durable-press garments or other textile articles by seamstresses or manufacturers who do not wish to employ postcuring processes.

Yet another object of this invention is to provide textile treating compositions and formulations which combine the features of using low cost finishing reagents and processes with the ability to make durable press textile products which can be permanently creased or otherwise heat set at any time after the textile finishing process is complete.

These and other objects of the present invention will become more clearly apparent from the following description.

SUMMARY OF THE INVENTION

We have discovered that smooth drying, wrinkle resistant, and crease retentive properties, known as durable press properties, together with an ability to accept new permanent creases or other configurations, may be imparted to cellulosic textiles by impregnating them with a solution made up of a methylol crosslinking reagent and either a half amide or a half salt of a dicarboxylic which is capable of forming a cyclic anhydride, and subsequently curing the impregnated textile at a high temperature. The dicarboxylic acids of this invention are 1,2- or 1,3-dicarboxylic acids which have their carboxyl group in a condiguration such that they can form a cyclic anhydride. This combination of properties in the treated textiles is unique and unexpected, since the dicarboxylic acids which have not been converted to half amides or half salts catalyze the crosslinking reaction of the methylol reagent, but do not combine with the cellulose and therefore do not remain in the fabric to catalyze the reaction necessary to form new creases in the cured durable-press fabric. On the other hand, experience with polycarboxylic acids of the prior art shows that if they are partially neutralized before they are used with methylol reagents, the acidity is decreased to such an extent that they are no longer active enough to catalyze the crosslinking reactions of the methylol reagent with cellulose to the extent of imparting acceptable levels of durable-press properties to the textile. Thus, knowledge of the prior art would lead one to expect that the process of this invention would give fabrics not having good durable press properties and that they would not be creasable after the original cure or after washing.

The treated textiles of this invention also show an unexpected and unique affinity for basic dyes, such as methylene blue. This affinity for basic dyes indicates that there is a high concentration of carboxylic acid groups on the surface of the treated fibers. A similar phenomenon is found when polymeric acids are used with methylol reagents in textile treatments, probably as a result of the large size of the polymeric acid molecules. This affinity for basic dyes does not occur when either polycarboxylic acids or hydroxy acids are used with methylol reagents in textile treatments.

DESCRIPTION OF THE INVENTION

In the practice of this invention, the cellulosic textile is impregnated with a solution containing a methylol crosslinking reagent and either a half amide of a dicarboxylic acid or a half salt of a dicarboxylic acid. The impregnation is best carried out by immersing the textile in the solution, and squeezing it between pad rolls in order to leave a known amount of the solution in the fabric (the wet pickup) determined by the squeeze pressure, the fiber composition, and the construction of the textile. The impregnated fabric is then cured at a high temperature in order to effect the crosslinking reaction and bind the carboxylic acid to the cellulose of the textile.

Substantially any cellulosic textile material may be used in the practice of this invention, but preferred materials are cellulosic textiles made either entirely of cotton fibers or of cotton fibers blended with other natural or synthetic fibers. The preferred textiles of this invention are either cotton or cotton/polyester blend woven fabrics containing at least 35% of cotton fiber.

The impregnating solution contains a methylol crosslinking reagent and either a half amide or a half salt of a 1,2- or 1,3-dicarboxylic acid which is capable of forming a cyclic anhydride. The solution may also contain other useful textile finishing agents, such as nonionic wetting agents or polymeric softeners. The methylol crosslinking reagent may be used in any desired concentration in the impregnating solution. The general practice is to use between 4 and 12% of the crosslinking reagent based on the weight of the fabric. It is the preferred practice of this invention to make up the impregnating solution so that the amount of methylol reagent deposited on the fabric is about 8% of the weight of the fabric. This concentration generally gives a good balance of resilience to strength retention, but higher concentration of the methylol reagent give better resilience at the cost of lower strength retention, and lower concentrations of the methylol reagent give better strength retention at the cost of lower resilience.

The methylol crosslinking reagents of this invention may be any conventional crosslinking agents used for finishing cellulosic textiles. The preferred reagent is dimethyloldihydroxyethyleneurea (DMDHEU), but other reagents which may be used in the practice of this invention include methylol melamines, methylol carbamates, ureaformaldehyde resins, methylol triazones, methylol urons, and other such reagents.

The half amide or half salt of the dicarboxylic acid may be used in a large range of concentrations in the impregnating solution. In the preferred practice of this invention, the concentration of the half amide or half salt is 50% of that of the methylol reagent or about 4% based on the weight of the fabric. However, the half amide or half salt may be used at concentrations as low as 1% and as high as 12% which can also be expressed as a ratio of about 12:1 to 0.33:1 of crosslinking reagent to amic acid or half salt. A concentration of 4% of the half amide or half salt is sufficient both to effectively catalyze the crosslinking reaction of the methylol reagent and to deposit sufficient carboxylic acid groups in the textile to make the cured textile creasable when pressed at high temperatures. Lower concentrations of the half amide or half salt will catalyze the crosslinking reaction but the creasability of the resulting fabrics is not as great. Higher concentrations of the half amide or half salt impart no improvement in properties above that of the preferred 4%, but may cause some loss of strength in the treated textiles.

The half-amides, or amic acids, of this invention are water soluble organic compounds having a carboxylic acid functional group separated by two or three atoms from a carboxamide group. The structure of the amic acids of the present invention may be depicted as follows:

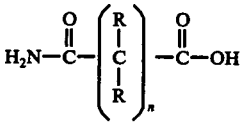

where $n$ can be 2 or 3 and R can be hydrogen or alkyl groups. The R group can be the same or different, and the carbon atoms may be joined by a double bond providing the double bonds permits the functional group to approach each other closely. Another requirement is that the two functional groups in the same molecule must be able to approach each other closely. This can come about either through flexibility of the chain linking functional group or through a rigidly fixed position in which the two functional groups are held close to each other. The dicarboxylic acids corresponding to these half amides can thus form cyclic anhydrides relatively easily.

Examples of the amic acids which can be used in the practice of this invention include maleic acid monoamide, succinic acid monoamide, phthalic acid monoamide, glutaric acid monoamide, oxydiacetic acid monoamide, itaconic acid monoamide, and aconitic acid monoamide. Tetracarboxylic acid diamides may also be used in this invention, provided that the arrangement of the carboxyl groups meet the requirements listed above. Examples of such acids include cyclopentane-1,4-dicarbonamido-2,3-dicarboxylic acid, tetrahydrofuran tetracarboxylic acid diamide, pyromellitic acid diamide, and mellitic acid di- or triamide. It is obvious that the monoamides of these acids can also be used.

These amic acids may of course be synthesized or otherwise obtained as pure compounds in a separate step before they are used in the process of this invention. However, since the anhydrides of these acids are generally available at moderate cost, it is easier to synthesize the half amide during the make-up of the pad bath. In this preferred method, the required amount of the anhydride is slowly added to a water solution containing one equivalent of ammonium hydroxide. The mixture is stirred until the anhydride has dissolved and reacted completely with the ammonium hydroxide to form the half amide. The methylol crosslinking reagent and any other desired finishing agents are then added and the solution is diluted with water to the desired concentration.

Half salts of 1,2- or 1,3-dicarboxylic acids may be used in the practice of this invention in place of the half amides. The dicarboxylic acids used as half salts are the same as those listed above for use as half amides. The salts may be either ammonium salts or alkali metal salts. The half salts which may be used in the practice of this invention include the mono- ammonium, sodium, and potassium salts of the following acids: maleic acid, succinic acid, phthalic acid, glutaric acid, oxydiacetic acid, itaconic acid, and aconic acid. In addition, the mono- or diammonium, sodium, or potassium salts of cyclopentane-tetracarboxylic acid, tetrahydrofuran tetracarboxylic acid, pyromellitic acid, and mellitic acid. It is of course possible to synthesize or otherwise obtain the half salts as pure chemical compounds, but it is more convenient to add the acid to water containing sufficient ammonium hydroxide, sodium hydroxide, or potassium hydroxide to neutralize one half of the carboxylic acid groups, then add the methylol crosslinking reagent and other desired textile finishing reagents, and enough water to make the desired concentrations.

The preferred acids in the practice of this invention are maleic acid monoamide, the monoammonium salt of maleic acid, the monosodium salt of maleic acid, and the monopotassium salt of maleic acid. These are chosen on the basis of low cost and higher resilience imparted by these catalysts, but other catalysts listed above are almost equivalent in both cost and resilience.

The impregnated fabric may be dried in a separate step before it is cured, but this drying step is not necessary for the practice of this invention. In the preferred practice, the impregnated wet fabric is cured immediately after the impregnation step with only the delays necessary to handling the fabric intervening between the impregnation step and the curing step. The curing step is carried out using any conventional equipment used for curing in conventional textile finishing operations. It is preferable that the textile be held in a flat configuration during the cure in order to avoid setting unwanted creases or wrinkles in the textiles. The preferred curing conditions in the practice of this invention are a temperature of 160° C and a curing time of two to four minutes. However, the curing temperature may vary between 120° and 200° C, and the curing time from 15 seconds to 12 minutes. In general, higher curing temperatures are used with shorter curing time. Textiles treated by the preferred practice of this invention have a weight add-on of about 8 to 10%. These add-ons indicate an efficient utilization of both the dicarboxylic acid derivative and the methylol crosslinking reagent. The treated textiles have high resilience, as measured by conditioned wrinkle recovery angles of 295° to 310°, measured in the warp and fill directions. The presence of a large concentration of acidic functional groups on the surface of fiber treated by the preferred practice is indicated by a high affinity for basic dyes. New, permanent, sharp creases can be formed in the treated textiles of this invention by heating them with a hand iron to 160° C for four minutes.

The following examples are presented to illustrate this invention and are not meant to limit its scope in any manner whatever:

EXAMPLE 1

An impregnating solution was prepared by slowly adding 20.0 grams of powdered maleic anhydride to a solution of 13.5 ml of 28% ammonium hydroxide (one molar equivalent) in 100 ml of water. The mixture was stirred until all of the solid had dissolved. Then 86.6 ml of a 45% solution of dimethyloldihydroxyethyleneurea (DMDHEU), 28 ml of a 30% suspension of a polyethylene softener, and 0.5 grams of a nonionic wetting agent and sufficient water to make a total volume of 500 ml were added. The impregnation solution thus contained 4.7% of maleamic acid, 8.0% of DMDHEU, 2.0% of the softener, and 0.1% of the wetting agent. The solution was used to impregnate desized, scoured, and bleached 80 × 80 cotton printcloth weighing 3.2 oz-/yd$^2$. The printcloth was impregnated by immersing it in the solution and squeezing it between pad rolls and repeating the operation. The pressure of the pad rolls was adjusted to give a wet pickup of 100%. The impregnated printcloth was placed on a pin frame and cured for four minutes at 160° C in a forced draft oven. After washing with a nonionic detergent, the treated printcloth had an add-on of 8.8%. This add-on indicates that over 70% of both the amic acid and the DMDHEU had been fixed in the textile. The treated printcloth had a conditioned wrinkle recovery angle (determined by the method of ASTM designation D 1295-67) of 304° (measured in the warp and fill directions) and a wet wrinkle recovery angle of 279° C (W+F). These high wrinkle recovery angles indicate that a high level of crosslinking had occurred in the textile. A sample of this treated printcloth was immersed in a water solution containing 0.2% of methylene blue and heated for 45 minutes, then thoroughly rinsed. The resulting deep blue color of the textile sample indicates that there was a high concentration of acidic groups on the surface of the cellulosic fibers. Another sample of the treated textile was washed with very dilute acid, then with deionized water and dried. This textile sample was folded and covered for four minutes with a hand iron which was kept at 160° C. The textile sample was then laundered and dried five times after which it retained a sharp, permanent crease. This permanent crease indicates that the acidic groups on the textile fibers had catalyzed a recuring reaction in which the positions of the methylol crosslinks had been changed.

EXAMPLE 2

An impregnation solution was made up by adding 4.0 grams of maleic acid to a solution of 2.0 ml of 28% ammonium hydroxide (1 molar equivalent) in 20 ml of water. After the acid dissolved, 17.8 ml of a 45% solution of DMDHEU, 6.0g of a 30% emulsion of a polymeric softener, and 0.1 g of a nonionic wetting agent and sufficient water to make up a total weight of 100 g were added. The solution thus contained 4.6% of monoammonium maleate, 8.0% of DMDHEU, 2.0% of softener, and 0.1% of wetting agent.

A sample of cotton printcloth was impregnated and cured by the process of Example 1 with the exception that the impregnation solution described above was used. This treated textile had an add-on of 8.5%, a conditioned wrinkle recovery angle of 311° (WL+F), and a wet wrinkle recovery angle of 293° (W+F). This textile was dyed to a deep shade by methylene blue and formed a sharp, permanent crease when pressed at 160° C for 4 minutes.

EXAMPLE 3

The procedure of Example 2 was followed with the exception that 1.37 g of sodium hydroxide was used in place of the ammonium hydroxide. The treated textile of this example had an add-on of 9.3%, a conditioned wrinkle recovery angle of 296° (W+F) and a wet wrinkle recovery angle of 271° (W+F). This textile was dyed to a deep shade by methylene blue and formed a sharp, permanent crease when pressed for four minutes at 160° C.

EXAMPLE 4

The procedure of Example 2 was followed with the exception that 1.9 g of potassium hydroxide was used in place of the ammonium hydroxide. The treated textile had an add-on of 9.7%, a conditioned wrinkle recovery angle of 310° (W+F) and a wet wrinkle recovery angle of 276° (W+F). This textile was dyed to a deep shade by methylene blue and formed a sharp, permanent crease when pressed for four minutes at 160° C.

EXAMPLE 5

The procedure of Example 1 was followed with the exception that the amounts of maleic anhydride and DMDHEU and the curing time and temperatures were changed. Table I lists the concentrations of maleic amide acid and DMDHEU in the impregnating solution and the curing times and temperatures together with the conditioned and wet wrinkle recovery angles of the treated textiles. These treated textiles were all dyes to a deep shade with methylene blue and formed permanent creases when pressed for four minutes at 160° C.

TABLE I

| Maleamic Acid (%) | DMDHEU (%) | Cure Temp.(° C) | Cure Time (min) | WRA (° W+F) Cond. | WRA (° W+F) Wet |
|---|---|---|---|---|---|
| 1.2 | 8.0 | 160 | 4 | 302 | 258 |
| 14.1 | 8.0 | 160 | 4 | 303 | 288 |
| 4.7 | 4.0 | 160 | 4 | 303 | 276 |
| 4.7 | 12.0 | 160 | 4 | 312 | 285 |
| 4.7 | 8.0 | 200 | 2 | 319 | 296 |
| 4.7 | 8.0 | 160 | 12 | 313 | 283 |
| 4.7 | 8.0 | 120 | 8 | 293 | 275 |

EXAMPLE 6

The procedure of Example 1 was followed with the exception that various cyclic anhydrides were substituted for maleic anhydride or various methylol crosslinking reagents were substituted for DMDHEU. Table II gives the cyclic anhydrides and crosslinking reagents together with the add-ons and the conditioned and wet wrinkle recovery angles of the treated textiles. All of these textiles were dyed to a deep shade with methylene blue and formed permanent creases when pressed for four minutes at 160° C.

TABLE II

| Anhydride | Methylol Reagent | Add-on (%) | WRA (° W+F) Cond. | WRA (° W+F) Wet |
|---|---|---|---|---|
| Maleic | Methylol Melamine | 9.0 | 280 | 235 |
| Maleic | Urea-Formaldehyde | 7.2 | 271 | 211 |
| Maleic | Methylol Carbamate | 7.0 | 274 | 240 |
| Succinic | DMDHEU | 8.7 | 290 | 253 |
| Phthalic | DMDHEU | 10.0 | 303 | 276 |
| Glutaric | DMDHEU | 12.0 | 292 | 260 |
| Cyclopentane-tetra-carboxylic Dianhydride | DMDHEU | 10.7 | 286 | 232 |

EXAMPLE 7

The procedure of Example 2 was followed with the exception that various acids were used in place of maleic acid or various crosslinking reagents were used in place of DMDHEU. Table Ii gives these acids and crosslinking reagents together with the add-ons and conditioned and wet wrinkle recovery angles of the treated textiles. All of these textiles were dyed to a deep shade with methylene blue and formed permanent creases when pressed for four minutes at 160° C.

TABLE III

| Acid | Methylol Reagent | Add-on (%) | WRA (° W+F) Cond. | WRA (° W+F) Wet |
|---|---|---|---|---|
| Maleic | Methylol Melamine | 7.9 | 268 | 239 |
| Maleic | Urea-Formaldehyde | 7.5 | 271 | 231 |
| Maleic | Methylol Carbamate | 7.0 | 277 | 247 |
| Succinic | DMDHEU | 8.3 | 288 | 268 |
| Phthalic | DMDHEU | 10.6 | 298 | 269 |
| Glutaric | DMDHEU | 12.2 | 279 | 264 |
| Cyclo-pentanetetra-carboxylic | DMDHEU | 9.0 | 261 | 233 |

We claim:

1. A process for imparting to cellulosic textiles improved properties of resilience, smooth drying, permanent creasability, and acidic character, the process comprising:

a. impregnating a cellulosic fabric with an aqueous solution containing a mixture having a ratio of about from 12:1 to 0:33:1 of a methylol crosslinking reagent and an amic acid of the general structure

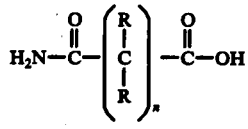

where $n$ is 2 or 3 and R is a hydrogen or an alkyl group wherein said R is the same or different from the other R groups, wherein the middle carbon atoms may be joined by a double bond or constitute part of a cyclic structure, and wherein the two functional groups in the same molecule must be able to approach each other closely; and b. drying and curing the wet impregnated cellulosic fabric at a high temperature.

2. In a process for imparting to cellulosic textiles acidic and hydrophilic properties, wherein the textile is impregnated with an aqueous solution of an amic acid, then dried and cured in one step, an improvement for providing properties of resilience, smooth drying, and permanent creasability to the textile, said improvement comprising:

a. impregnating a cellulose textile with an aqueous solution containing a mixture having a ratio of about from 12:1 to 0:33:1 of a methylol crosslinking reagent and an amic acid, and b. drying and curing in one step the wet impregnated textile.

3. In a process for imparting to cellulosic textiles acidic and hydrophilic properties, wherein the textile is impregnated with an aqueous solution of an amic acid, then dried and cured in one step, an improvement for providing properties of resilience, smooth drying and permanent creasability to the textiles, said improvement comprising:

a. impregnating a cellulosic textile with a 5 to 26% aqueous solution of a mixture of a ratio from about 12:1 to 0:33:1 of a methylol crosslinking reagent selected from the group consisting of
dimethyloldihydroxyethyleneurea,
a methylol melamine,
a methylol carbamate, and
a urea-formaldehyde resin,
and an amic acid selected from the group consisting of
maleic acid monoamide,
succinic acid monoamide,
phthalic acid monoamide, and
glutaric acid monoamide;

b. drying and curing in one step the wet impregnated cellulosic textile for about from 15 seconds to 12 minutes at a temperature of about from 120° to 200° C.

4. The process of claim 3 wherein the methylol crosslinking reagent is dimethyloldihydroxyethyleneurea.

5. The process of claim 3 wherein the methylol crosslinking reagent is a methylol melamine.

6. The process of claim 3 wherein the methylol crosslinking reagent is a methylol carbamate.

7. The process of claim 3 wherein the methylol crosslinking agent is a urea-formaldehyde resin.

8. The process of claim 3 wherein the amic acid is maleic acid monoamide.

9. The process of claim 3 wherein the amic acid is succinic acid monoamide.

10. The process of claim 3 wherein the amic acid is phthalic acid monoamide.

11. The process of claim 3 wherein the amic acid is glutaric acid monoamide.

12. A cellulosic textile produced by any of the combinations of a methylol crosslinking reagent and amic cited in claim 3.

13. A process for imparting to cellulosic textiles improved properties of resilience, smooth drying, permanent creasability, and acidic character, the process comprising:

a. impregnating a cellulosic textile with an aqueous solution containing a mixture having a ratio of about from 12:1 to 0:33:1 of a methylol crosslinking reagent and a half salt of a dicarboxylic acid having the general structure

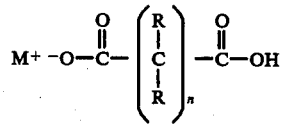

wherein $n$ is 2 or 3 and R is a hydrogen or an alkyl group, wherein said R is the same or different from the other R groups in the molecule, and $M^+$ is a monovalent cation, wherein the middle carbon atoms may be joined by a double bond or constitute part of a cyclic structure, and wherein the two functional groups in the same molecule must be able to approach each other closely; and b. drying and curing the wet impregnated cellulosic textile at a high temperature.

14. In a process for imparting to cellulosic textile properties of resilience, smooth drying, and permanent creasability, wherein the cellulosic textile is impregnated with a solution containing a methylol reagent and a polycarboxylic acid, dried, then cured, an improvement for providing acidic character to the textiles, said improvement comprising:

a. impregnating a cellulosic textile with an aqueous solution of a mixture having a ratio of about from 12:1 to 0:33:1 of a methylol crosslinking reagent and a half salt of a dicarboxylic acid, and b. drying and curing the wet impregnating cellulosic textile.

15. In a process for imparting to cellulosic textiles acidic and hydrophilic properties, wherein the textile is impregnated with an aqueous solution of an amic acid, then dried and cured in one step, an improvement for providing properties of resilience, smooth drying and permanent creasability to the textile, said improvement comprising:

a. impregnating a cellulosic textile with a 5 to 26% aqueous solution of a mixture of a ratio from about 12:1 to 0:33:1 of a methylol crosslinking reagent selected from the group consisting of
dimethyloldihydroxyethyleneurea
a methylol melamine,
a methylol carbamate, and
a urea-formaldehyde resin,
and half salt of a dicarboxylic acid selected from the group consisting of
monoammonium maleate,
monosodium maleate,
monopotassium maleate,
monoammonium succinate,
monoammonium phthalate,
monoammonium glutarate; and b. drying and curing in one step the wet impregnated cellulosic textile for about from 15 sec to 12 minutes at a temperature of about from 120° to 200° C.

16. The process of claim 15 wherein the methylol crosslinking reagent is dimethyloldihydroxyethyleneurea.

17. The process of claim 15 wherein the methylol crosslinking reagent is a methylol melamine.

18. The process of claim 15 wherein the methylol crosslinking reagent is a methylol carbamate.

19. The process of claim 15 wherein the methylol crosslinking reagent is a urea-formaldehyde resin.

20. The process of claim 15 wherein the half salt is monoammonium maleate.

21. The process of claim 15 wherein the half salt is monosodium maleate.

22. The process of claim 15 wherein the half salt is monopotassium maleate.

23. The process of claim 15 wherein the half salt is monoammonium succinate.

24. The process of claim 15 wherein the half salt is monoammonium phthalate.

25. The process of claim 15 wherein the half salt is monoammonium glutarate.

26. A cellulosic textile produced by any of the combinations of a methylol crosslinking reagent and a half salt of a dicarboxylic acid cited in claim 15.

27. A process for imparting to cellulosic textiles improved properties of resilience, smooth drying, permanent creasability, and acidic character, the process comprising:

a. adding a cyclic anhydride of a 1,2- or a 1,3-dicarboxylic acid to a solution of a molar equivalent amount of ammonium hydroxide, and b. stirring the mixture of the anhydride and ammonium hydroxide until the anhydride has dissolved and reacted with the ammonium hydroxide to form the amic acid corresponding to the anhydride, and c. adding a methylol crosslinking reagent to the solution to form a ratio of about from 12:1 to 0:33:1 of crosslinking reagent to amic acid, and d. impregnating a cellulosic textile with the above solution, and e. drying and curing the wet, impregnated cellulosic textile at a high temperature.

28. A process for imparting to cellulosic textiles improved properties of resilience, smooth drying, permanent creasability, and acidic character, the process comprising:

a. adding a 1,2- or a 1,3-dicarboxylic acid, which is capable of forming a cyclic anhydride, to an aqueous solution of a molar equivalent amount of a hydroxide of a monovalent cation, and b. stirring the mixture until the dicarboxylic acid has dissolved and reacted with the hydroxide to form the half salt of the dicarboxylic acid, and c. adding a methylol crosslinking reagent to the solution to form a ratio of about from 12:1 to 0:33:1 of crosslinking agent to half salt, and d. impregnating a cellulosic textile with the solution of the half salt and the methylol crosslinking reagent, and e. drying and curing the wet, impregnated cellulosic textile at a high temperature.

* * * * *